US010012421B2

(12) United States Patent
Junge et al.

(10) Patent No.: US 10,012,421 B2
(45) Date of Patent: Jul. 3, 2018

(54) EVAPORATOR FOR AN APPLIANCE

(71) Applicant: General Electric Company, Schenectady, NY (US)

(72) Inventors: Brent Alden Junge, Evansville, IN (US); Michael John Kempiak, Osceola, IN (US); Anna Fenko, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 275 days.

(21) Appl. No.: 15/006,188

(22) Filed: Jan. 26, 2016

(65) Prior Publication Data

US 2017/0211858 A1 Jul. 27, 2017

(51) Int. Cl.
*F25B 39/02* (2006.01)

(52) U.S. Cl.
CPC ..... *F25B 39/028* (2013.01)

(58) Field of Classification Search
CPC ..... F25B 2400/0409
See application file for complete search history.

(56) References Cited

U.S. PATENT DOCUMENTS 5,279,360 A * 1/1994 Hughes ..... F25B 39/02 165/111
5,806,585 A * 9/1998 Yoshida ..... B23K 1/0012 165/171
2007/0215333 A1* 9/2007 Viklund ..... F25B 40/06 165/172

FOREIGN PATENT DOCUMENTS

JP H08327181 A 12/1996

* cited by examiner

*Primary Examiner* — Elizabeth Martin
(74) *Attorney, Agent, or Firm* — Dority & Manning, P.A.

(57) ABSTRACT

An evaporator for an appliance includes a conduit extending between an inlet and an outlet. The conduit has a diameter. The diameter of the conduit is less than three-eighths of an inch. A vapor bypass is mounted to the conduit such that the vapor bypass extends between the inlet of the conduit and the outlet of the conduit. The vapor bypass has a diameter. The diameter of the vapor bypass is less than the diameter of the conduit.

16 Claims, 2 Drawing Sheets

EVAPORATOR FOR AN APPLIANCE

FIELD OF THE INVENTION

The present subject matter relates generally to evaporators for appliances, such as refrigerator appliances.

BACKGROUND OF THE INVENTION

Refrigerators generally include a sealed system for cooling fresh food and freezer chambers of the refrigerators. The sealed systems expand compressed refrigerant in order to reduce a temperature of the refrigerant and then supply the cool refrigerant to an evaporator. At the evaporator, heat exchange with air within the fresh food chamber and/or freezer chamber cools the air to assist with storage of food items within the refrigerator.

At an entrance to the evaporator, refrigerant can be approximately twenty to thirty percent vapor by mass. In contrast, the refrigerant is mostly vapor by volume at the entrance to the evaporator because the vapor specific volume of the refrigerant is many times larger than the liquid specific volume of the refrigerant. Thus, a velocity of the vapor/liquid mix refrigerant at the entrance of the evaporator can be slow relative to a situation where only liquid refrigerant enters the evaporator. The relatively high velocity of the vapor/liquid mix refrigerant at the entrance of the evaporator generally requires that a greater length or cross-section area for the evaporator thereby increasing a material cost for the evaporator.

Accordingly, an evaporator with features for decreasing a velocity of refrigerant at an entrance of the evaporator would be useful.

BRIEF DESCRIPTION OF THE INVENTION

The present subject matter provides an evaporator for an appliance. The evaporator includes a conduit extending between an inlet and an outlet. The conduit has a diameter. The diameter of the conduit is less than three-eighths of an inch. A vapor bypass is mounted to the conduit such that the vapor bypass extends between the inlet of the conduit and the outlet of the conduit. The vapor bypass has a diameter. The diameter of the vapor bypass is less than the diameter of the conduit. Additional aspects and advantages of the invention will be set forth in part in the following description, or may be apparent from the description, or may be learned through practice of the invention.

In a first exemplary embodiment, an evaporator for an appliance is provided. The evaporator includes a conduit that extends between an inlet and an outlet. The conduit is configured for receiving refrigerant at the inlet of the conduit and directing the refrigerant through the conduit to the outlet of the conduit. The conduit has a diameter. The diameter of the conduit is less than three-eighths of an inch. A vapor bypass is mounted to the conduit such that the vapor bypass extends between the inlet of the conduit and the outlet of the conduit. The vapor bypass is configured for directing vapor refrigerant through the vapor bypass such that the vapor refrigerant bypasses the conduit. The vapor bypass has a diameter. The diameter of the vapor bypass is less than the diameter of the conduit.

In a second exemplary embodiment, an evaporator for an appliance is provided. The evaporator includes a conduit that extends between an inlet and an outlet. The conduit has a serpentine segment between the inlet and outlet of the conduit. The conduit is configured for receiving refrigerant at the inlet of the conduit and directing the refrigerant through the conduit to the outlet of the conduit. The conduit has a diameter. The diameter of the conduit is less than three-eighths of an inch. A vapor bypass is mounted to the conduit such that the vapor bypass extends between the inlet of the conduit and the outlet of the conduit. The vapor bypass is configured for directing vapor refrigerant through the vapor bypass such that the vapor refrigerant bypasses the conduit. The vapor bypass has a diameter. The diameter of the vapor bypass is less than the diameter of the conduit. A capillary tube is mounted to the conduit. An exit of the capillary tube is positioned below the vapor bypass within the conduit at the inlet of the conduit. A spine fin heat exchanger is wound about the conduit at an outer surface of the conduit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
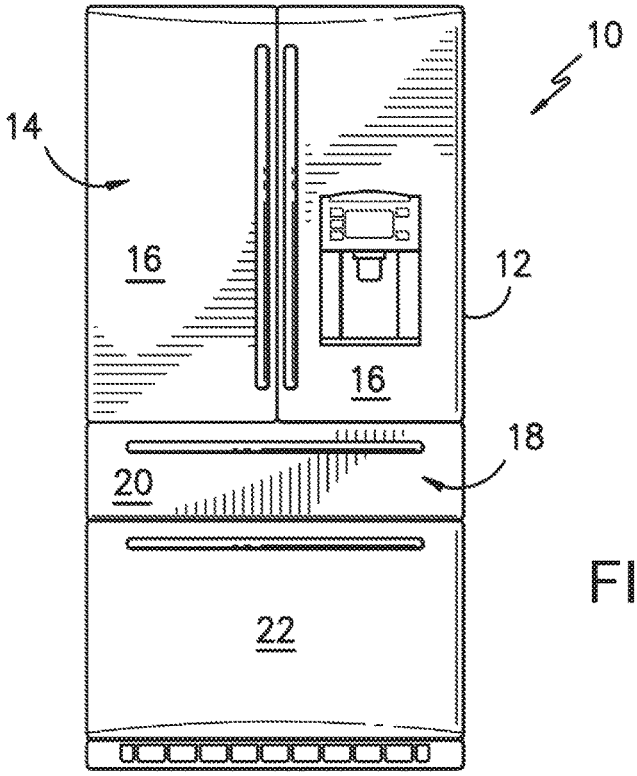
FIG. 1 is a front elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
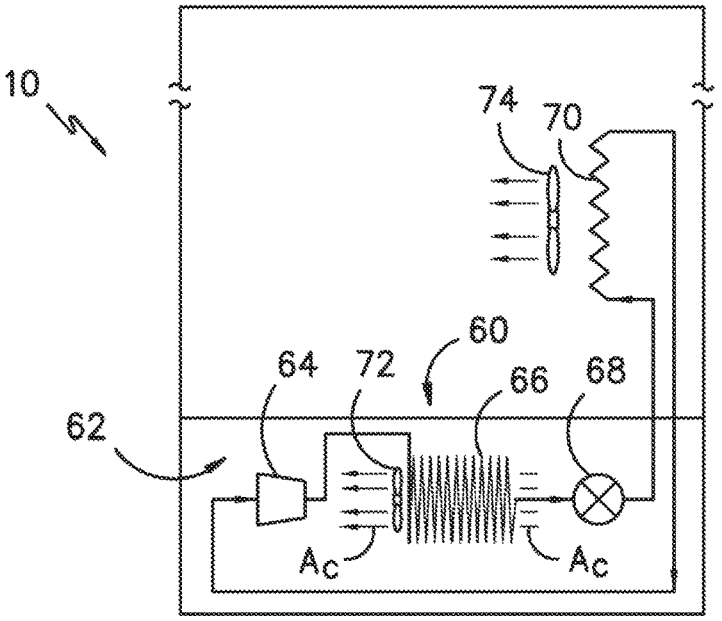
FIG. 2 is schematic view of certain components of the exemplary refrigerator appliance of FIG. 1.

FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in appliances. Thus, the present subject matter may be used for any other suitable purpose, such as in HVAC units.

In the exemplary embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having upper drawer 20 and lower drawer 22. The drawers 20 and 22 are "pull-out" drawers in that they can be manually moved into and out of the freezer compartment 18 on suitable slide mechanisms.

FIG. 2 is a schematic view of certain components of refrigerator appliance 10, including a sealed refrigeration system 60 of refrigerator appliance 10. A machinery compartment 62 contains components for executing a known vapor compression cycle for cooling air. The components include a compressor 64, a condenser 66, an expansion device 68, and an evaporator 70 connected in series and charged with a refrigerant. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, refrigerant flows into compressor 64, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A condenser fan 72 is used to pull air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device (e.g., a valve, capillary tube, or other restriction device) 68 receives refrigerant from condenser 66. From expansion device 68, the refrigerant enters evaporator 70. Upon exiting expansion device 68 and entering evaporator 70, the refrigerant drops in pressure. Due to the pressure drop and/or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70. An evaporator fan 74 is used to pull air across evaporator 70 and circulated air within compartments 14 and 18 of refrigerator appliance 10.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present subject matter for other configurations of the refrigeration system to be used as well.

Figure 3:
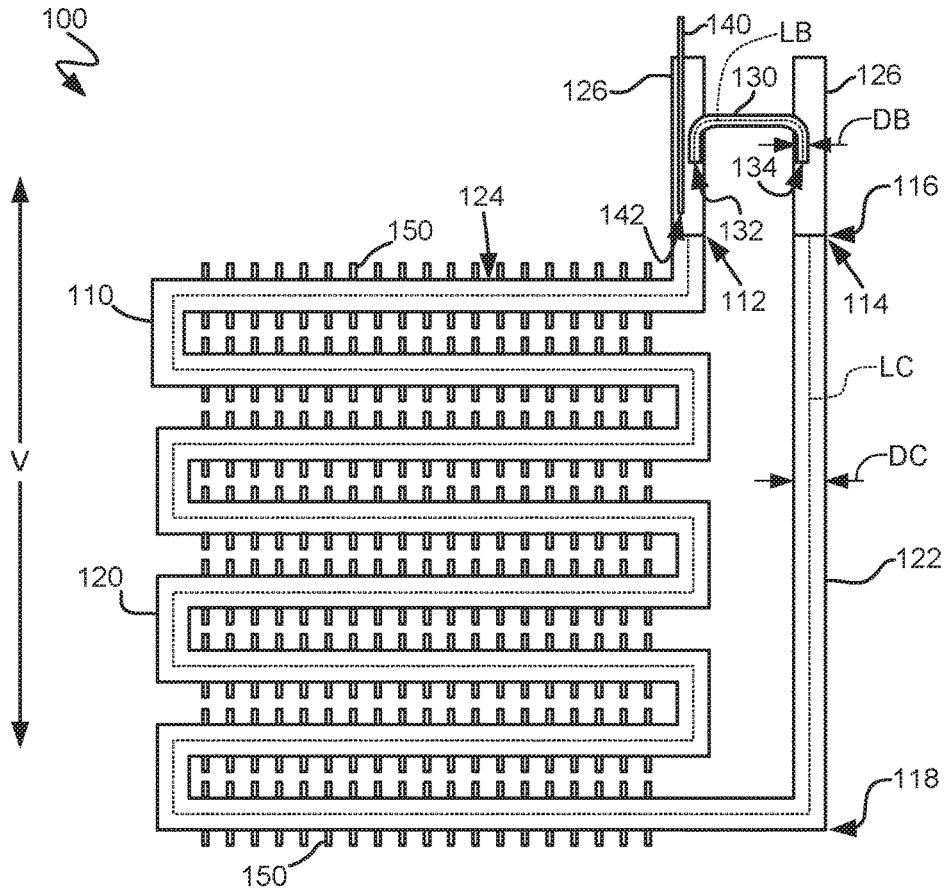
FIG. 3 provides a schematic, section view of an evaporator according to an exemplary embodiment of the present subject matter.

FIG. 3 provides a schematic, section view of an evaporator 100 according to an exemplary embodiment of the present subject matter. Evaporator 100 may be used in or with any suitable sealed system. For example, evaporator 100 may be used in or with refrigeration system 60 as evaporator 70 (FIG. 2). Thus, evaporator 100 is discussed in greater detail below in the context of refrigerator appliance 10 and refrigeration system 60. In alternative exemplary embodiments, evaporator 100 may be used in or with any other suitable appliance, such as another refrigerator appliance, a heat pump water heater, an HVAC system, etc. As discussed in greater detail below, evaporator 100 includes features for separating liquid phase refrigerant from vapor phase refrigerant and directing the vapor phase refrigerant around portions of evaporator 100. In such a manner, an efficiency of evaporator 100 may be improved relative to an evaporator without the phase separating features of evaporator 100.

As may be seen in FIG. 3, evaporator 100 includes a conduit 110 that extends, e.g., longitudinally, between an inlet 112 and an outlet 114. Conduit 110 may be any suitable tubing, piping, etc. for containing a flow of refrigerant. As a particular example, conduit 110 may include a continuous piece of aluminum or copper tubing that extends from inlet 112 of conduit 110 to outlet 114 of conduit 110. A flow of refrigerant within refrigeration system 60 enters conduit 110 at inlet 112 of conduit 110. Conduit 110 guides or directs the flow of refrigerant through conduit 110 to outlet 114 of conduit 110. From outlet 114, the flow of refrigerant may return to compressor 64.

Conduit 110 also extends between or includes a top portion 116 and a bottom portion 118. Top portion 116 and bottom portion 118 of conduit 110 may be spaced apart from each other, e.g., along a vertical direction V. In particular, top portion 116 of conduit 110 may be positioned above bottom portion 118 of conduit 110, e.g., along the vertical direction V. Inlet 112 and outlet 114 of conduit 110 may both be positioned at or adjacent top portion 116 of conduit 110.

Conduit 110 may be bent or formed into any suitable shape. For example, as shown in FIG. 3, conduit 110 may be bent or formed to include a serpentine segment or section 120 and a linear segment or section 122. Linear section 122 of conduit 110 may be disposed or formed downstream of serpentine section 120 of conduit 110 relative to the flow of refrigerant through conduit 110. Serpentine section 120 of conduit 110 includes a plurality of bends. Thus, refrigerant flowing through serpentine section 120 of conduit 110 may change directions multiple times. Serpentine section 120 of conduit 110 may be provided or formed in order to permit conduit 110 to have a long length LC between inlet 112 and outlet 114 of conduit 110 while also reducing a foot print of evaporator 100 within refrigerator 10. Linear section 122 of conduit 110 extends from bottom portion 118 of conduit 110 to top portion 116 of conduit 110. Thus, after flowing through serpentine section 120 of conduit 110 from top portion 116 to bottom portion 118 of conduit 110, the refrigerant within conduit 110 may flow back towards top portion 116 of conduit 110 (e.g., and outlet 114) via linear section 122 of conduit 110.

Conduit 110 also includes a pair of jumper tubes 126. Jumper tubes 126 are each positioned at a respective one of inlet 112 and outlet 114 of conduit 110. Jumper tubes 126 may assist with coupling evaporator 100 to other components of refrigeration system 60. For example, as discussed above, conduit 110 may include aluminum tubing between inlet 112 and outlet 114 of conduit 110. In contrast, jumper tubes 126 may be copper tubing. Copper tubing can be significantly easier to join together with solder compared to aluminum tubing. Thus, jumper tubes 126 may facilitate connection of evaporator 100 into refrigeration system 60 by providing a connection point to adjacent tubing.

Conduit 110 has a diameter DC. The diameter DC of conduit 110 is less than three-eighths of an inch. In particular, the diameter of conduit 110 may be no greater than five-sixteenths of an inch and no less than three-sixteenths of an inch, in certain exemplary embodiments. Thus, the diameter DC of conduit 110 may be small, and conduit 110 may require less material than conduits with larger diameters and similar wall thicknesses. In addition, refrigeration system 60 may require less refrigerant to charge refrigeration system 60 when equipped with evaporator 100 having conduit 110 where the diameter DC of conduit 110 is less than three-eighths of an inch than if evaporator 100 included a conduit with a larger diameter. Requiring less refrigerant may assist with reducing manufacturing costs for refrigerator 10 (e.g., when refrigeration system 60 is charged with expensive R134a) and/or with compliance with regulatory codes (e.g., when refrigeration system 60 is charged with flammable R600a).

Because the diameter DC of conduit 110 is less than three-eighths of an inch, evaporator 100 also includes features for reducing a pressure drop across evaporator 100 (e.g., between inlet 112 and outlet 114 of conduit 110). In particular, evaporator 100 includes a vapor bypass 130. Vapor bypass 130 is mounted to conduit 110 such that vapor bypass 130 extends between inlet 112 of conduit 110 and outlet 114 of conduit 110, e.g., at top portion 116 of conduit 110. In particular, an entrance 132 of vapor bypass 130 is positioned at or in conduit 110 at inlet 112 of conduit 110, and an exit 134 of vapor bypass 130 is positioned at or in conduit 110 at outlet 114 of conduit 110. Vapor bypass 130 is configured for directing vapor refrigerant at inlet 112 of conduit 110 through vapor bypass 130 to outlet 114 of conduit 110 such that the vapor refrigerant bypasses conduit 110. Thus, vapor bypass 130 assists with separating liquid phase refrigerant from vapor phase refrigerant at inlet 112 of conduit 110 and directing the vapor phase refrigerant around conduit 110.

By providing vapor bypass 130, a velocity of the flow of refrigerant through conduit 110 at or adjacent inlet 112 of conduit 110 may be decreased relative to evaporators without vapor bypass 130. For example, the flow of refrigerant at inlet 112 of conduit 110 can be approximately twenty to thirty percent vapor by mass and mostly vapor by volume. Separating the vapor phase refrigerant from the liquid phase refrigerant and directing the vapor phase refrigerant around conduit 110 can greatly decrease the velocity of the flow of refrigerant through conduit 110, e.g., due to the reduced volume of the refrigerant. In turn, the low refrigerant velocity at inlet 112 of conduit 110 can result in a reduced pressure drop relative to evaporators without vapor bypass 130 without a reduction in cooling, e.g., because the quantity of liquid phase refrigerant at inlet 112 of conduit 110 is unchanged.

Vapor bypass 130 may be sized such that a pressure drop of the vapor phase refrigerant through vapor bypass 130 is about equal to a pressure drop of the flow of refrigerant through conduit 110. As used herein, the term "about" means with five percent of the stated pressure drop when used in the context of pressure drops. As shown in FIG. 3, vapor bypass 130 has a diameter DB. The diameter DB of vapor bypass 130 is less than the diameter DC of conduit 110. As an example, the diameter DB of vapor bypass 130 may be at least ten percent, at least twenty percent or at least thirty percent less than the diameter DC of conduit 110. Vapor bypass 130 also defines a length LB, e.g., between inlet 112 and outlet 114 of conduit 110. As an example, the length LB of vapor bypass 130 may be less than three inches, in certain exemplary embodiments. Conduit 110 also defines a length LC, e.g., between inlet 112 and outlet 114 of conduit 110. The length LB of vapor bypass 130 may be significantly less than the length LC of conduit 110. As an example, the length LC of conduit 110 may be no less than ten times, twenty times or thirty times greater than the length LB of vapor bypass 130. Thus, vapor bypass 130 may be significantly shorter than conduit 110. The diameter DB of the vapor bypass 130 and/or the length LB of vapor bypass 130 may be selected such that the pressure drop of the vapor refrigerant through vapor bypass 130 is about equal to the pressure drop of the flow of refrigerant through conduit 110. In such a manner, liquid refrigerant flow through vapor bypass 130 may be reduced or eliminated.

Vapor bypass 130 may be any suitable type of conduit, such as tubing or piping. As an example, vapor bypass 130 may be copper tubing. As shown in FIG. 3, vapor bypass 130 may extend between and be mounted to jumper tubes 126. Thus, vapor bypass 130 may be soldered to jumper tubes 126 in order to mount vapor bypass 130 to conduit 110 such that vapor bypass 130 extends between inlet 112 of conduit 110 and outlet 114 of conduit 110.

As shown in FIG. 3, a capillary tube 140 may be mounted to conduit 110 at inlet 112 of conduit 110. An exit 142 of capillary tube 140 is positioned below vapor bypass 130 (e.g., entrance 132 of vapor bypass 130) within conduit 110 at inlet 112 of conduit 110. Thus, entrance 132 of vapor bypass 130 may be positioned above exit 142 of capillary tube 140 along the vertical direction V. In such a manner, phase separation of refrigerant at inlet 112 of conduit 110 and removal of vapor phase refrigerant via vapor bypass 130 may be facilitated. In particular, vapor phase refrigerant may collect within conduit 110 above exit 142 of capillary tube 140 due to the density difference between vapor phase refrigerant and liquid phase refrigerant, and the vapor phase refrigerant may flow into vapor bypass 130 at entrance 132 of vapor bypass 130 above exit 142 of capillary tube 140. In contrast, liquid phase refrigerant may flow downwardly along the vertical direction V from exit 142 of capillary tube 140 into conduit 110 and away from entrance 132 of vapor bypass 130. Entrance 132 of vapor bypass 130 (and/or exit 134 of vapor bypass 130) may also face downwardly along the vertical direction V, e.g., in order to limit any flow of liquid phase refrigerant into vapor bypass 130.

Conduit 110 also defines an outer surface 124. A spine fin heat exchanger 150 is wound onto conduit 110 at outer surface 124 of conduit 110. In particular, spine fin heat exchanger 150 may form a helix on outer surface 124 of conduit 110. Spine fin heat exchanger 150 assist with heat transfer between air passing over evaporator 100 and refrigerant flowing through conduit 110, e.g., by increasing a heat exchange surface exposed to the air about evaporator 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An evaporator for an appliance, comprising:

an elongated conduit extending longitudinally between an inlet and an outlet, the conduit configured for receiving refrigerant at the inlet of the conduit and directing the refrigerant through the conduit to the outlet of the conduit, the conduit having a diameter, the diameter of the conduit being less than three-eighths of an inch;

a vapor bypass mounted to the conduit such that the vapor bypass extends between the inlet of the conduit and the outlet of the conduit, the vapor bypass configured for directing vapor refrigerant through the vapor bypass such that the vapor refrigerant bypasses the conduit, the vapor bypass having a diameter, the diameter of the vapor bypass being less than the diameter of the conduit; and a capillary tube mounted to the conduit at the inlet of the conduit, the capillary tube extending downwardly into the conduit such that an exit of the capillary tube is positioned below the vapor bypass within the conduit at the inlet of the conduit, wherein the inlet of the conduit is positioned at a top portion of the conduit.

2. The evaporator of claim 1, further comprising a spine fin heat exchanger wound about the conduit at an outer surface of the conduit.

3. The evaporator of claim 1, wherein the conduit comprises a pair of jumper tubes, each jumper tube of the pair of jumper tubes positioned at a respective one of the inlet and outlet of the conduit, the vapor bypass to the mounted to the jumper tubes of the pair of jumper tubes.

4. The evaporator of claim 3, wherein the vapor bypass is soldered to the jumper tubes of the pair of jumper tubes.

5. The evaporator of claim 3, wherein the conduit further comprises aluminum tubing, the jumper tubes of the pair of jumper tubes comprising copper jumper tubes.

6. The evaporator of claim 1, wherein the conduit defines a serpentine segment between the inlet and outlet of the conduit.

7. The evaporator of claim 1, wherein the outlet of the conduit is positioned at the top portion of the conduit.

8. The evaporator of claim 1, wherein the diameter of the bypass conduit and a length of the bypass conduit are selected such that a pressure drop of the vapor refrigerant through the vapor bypass is about equal to a pressure drop of the refrigerant through the conduit.

9. The evaporator of claim 1, wherein the diameter of the conduit is no greater than five-sixteenths of an inch and no less than three-sixteenths of an inch.

10. An evaporator for an appliance, comprising:

an elongated conduit extending longitudinally between an inlet and an outlet, the conduit having a serpentine segment between the inlet and outlet of the conduit, the conduit configured for receiving refrigerant at the inlet of the conduit and directing the refrigerant through the conduit to the outlet of the conduit, the conduit having a diameter, the diameter of the conduit being less than three-eighths of an inch;

a vapor bypass mounted to the conduit such that the vapor bypass extends between the inlet of the conduit and the outlet of the conduit, the vapor bypass configured for directing vapor refrigerant through the vapor bypass such that the vapor refrigerant bypasses the conduit, the vapor bypass having a diameter, the diameter of the vapor bypass being less than the diameter of the conduit;

a capillary tube mounted to the conduit, the capillary tube extending downwardly into the conduit such that an exit of the capillary tube is positioned below the vapor bypass within the conduit at the inlet of the conduit; and a spine fin heat exchanger wound about the conduit at an outer surface of the conduit, wherein the inlet of the conduit is positioned at a top portion of the conduit.

11. The evaporator of claim 10, wherein the conduit comprises a pair of jumper tubes, each jumper tube of the pair of jumper tubes positioned at a respective one of the inlet and outlet of the conduit, the vapor bypass to the mounted to the jumper tubes of the pair of jumper tubes.

12. The evaporator of claim 11, wherein the vapor bypass comprises tubing soldered to the jumper tubes of the pair of jumper tubes.

13. The evaporator of claim 11, wherein the conduit further comprises aluminum tubing, the jumper tubes of the pair of jumper tubes comprising copper jumper tubes.

14. The evaporator of claim 10, wherein the outlet of the conduit is positioned at the top portion of the conduit.

15. The evaporator of claim 10, wherein the diameter of the bypass conduit and a length of the bypass conduit are selected such that a pressure drop of the vapor refrigerant through the vapor bypass is about equal to a pressure drop of the refrigerant through the conduit.

16. The evaporator of claim 10, wherein the diameter of the conduit is no greater than five-sixteenths of an inch and no less than three-sixteenths of an inch.

* * * * *